US005726618A

United States Patent [19]

Römer

[11] Patent Number: 5,726,618

[45] Date of Patent: Mar. 10, 1998

[54] PLANAR TRANSDUCTOR

[75] Inventor: Friedhelm Römer, Delbrück, Germany

[73] Assignee: Siemens Nixdorf Informationssysteme Aktiengesellschaft, Paderborn, Germany

[21] Appl. No.: 586,867

[22] PCT Filed: Jun. 10, 1994

[86] PCT No.: PCT/DE94/00654

§ 371 Date: Jan. 24, 1996

§ 102(e) Date: Jan. 24, 1996

[87] PCT Pub. No.: WO95/03617

PCT Pub. Date: Feb. 2, 1995

[30] Foreign Application Priority Data

Jul. 26, 1993 [DE] Germany ..... 4325056.4

[51] Int. Cl.[6] ..... H01F 2/30

[52] U.S. Cl. ..... 336/175

[58] Field of Search ..... 336/175, 174; 321/10; 363/68; 323/89

[56] References Cited

U.S. PATENT DOCUMENTS

| | | | |
|---|---|---|---|
| 3,916,286 | 10/1975 | Waehner | 321/10 |
| 4,700,166 | 10/1987 | Bradt et al. | 336/175 |

FOREIGN PATENT DOCUMENTS

| | | |
|---|---|---|
| 1 068 736 | 6/1954 | France . |
| 1068736 | 6/1954 | France . |
| 2 468 983 | 5/1981 | France . |
| 25 44 574 | 4/1977 | Germany . |
| 33 12 124 | 10/1984 | Germany . |
| 34 33 973 | 3/1986 | Germany . |
| 38 43 183 | 7/1990 | Germany . |
| 285431 | 12/1990 | Germany . |
| 41 18 918 | 12/1992 | Germany . |
| 618398 | 2/1949 | United Kingdom . |
| 735304 | 8/1955 | United Kingdom . |

OTHER PUBLICATIONS

AEG Handbook, vol. 1, No. 2, Berlin, 1976, pp. 188 and 395.

*Primary Examiner*—Peter S. Wong
*Assistant Examiner*—Rajnikant B. Patel
*Attorney, Agent, or Firm*—Hill, Steadman & Simpson

[57] ABSTRACT

Planar transductor consisting of one or more rectangular ferrite cores having a rectangular passage through which a metallic section of rectangular cross section is guided, in particular for the secondary control of a power supply unit.

6 Claims, 2 Drawing Sheets

PLANAR TRANSDUCTOR

BACKGROUND OF THE INVENTION

The arrangement relates to controlling the power flow using transductors, in particular in switched mode power supplies.

PRIOR ART

Switched mode power supplies are used to a large extent for tasks in which large output currents are needed at low voltages, for example in power supply units for high-power computers. Here, a plurality of voltages are generally needed on the secondary side. For this purpose, a plurality of output windings are used which are rectified separately. In this arrangement, regulation on the primary side cannot balance out load differences on the various output voltages, with the result that an additional secondary regulation is necessary. For this purpose, the use of transductors, that is to say of coils controlled into magnetic saturation, has proven worthwhile.

SUMMARY OF THE INVENTION

It is the object of the invention to provide arrangements which at low cost, achieve transductors for currents up to 300 A in the low voltage range with a low stray inductance and easy manufacture.

The invention uses one-piece cores of rectangular shape, through which the primary winding to be controlled is guided as a copper section having one turn. In this case, the use of one-piece cores, which are known in toroidal form as ring cores, is particularly advantageous, because a high permeability is achieved as a result of the omission of an air gap. The necessary cross section in the case of cuboidal cores can be achieved in a simple manner by lining up a plurality of cores.

As a result of the rectangular cross section, in conjunction with a rectangular conductor for the primary coil, almost complete filling of the interior space is achieved. The use of a flat section for the primary coil which is guided back outside the core at a small separation from the inner part is particularly advantageous. As a result a particularly low residual or stray inductance is achieved. The control winding, in contrast to a conventional ring core, can be wound in layers.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
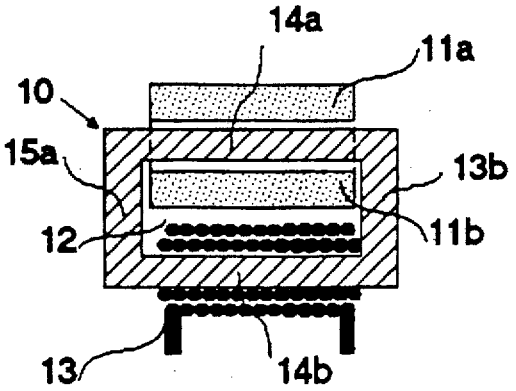
FIG. 1 shows a section through a core having a controlled winding and a controlling winding.

FIG. 1 shows a section through a one-piece core 10 made of highly permeable material having low eddy current losses, for example a ferrite. This core has the shape of a cube which has a cuboidal passage 12 and thus has a closed iron path having two legs 14*a*, 14*b* and yokes 15*a*, 15*b* connecting them. A primary winding 11*a*, 11*b* is laid around one leg 14*a* and a control winding 13 is fitted on the other leg 14*b*. The primary winding comprises a metallic section which is as broad as the passage in the core and whose cross section is preferably about half the cross section of the passage. The control winding 13 comprises one or more layers of insulated wire.

Figure 2:
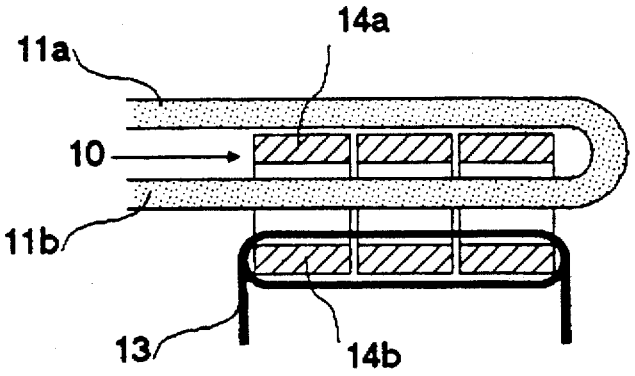
FIG. 2 shows a cross section through a plurality of cores having windings and FIG. 3 shows an application circuit in a primary-clocked power supply unit.

In FIG. 2, this arrangement is shown in cross section. In this case the preferred embodiment is shown, in which the primary winding 11*a*, 11*b* is a flat section made of copper or aluminum and bent or coiled into a U-shape, over which during assembly a prepared core set, already provided with the control winding, is pushed. After this, the flat section is screwed directly to the rectifier connections (not shown) and the control winding 13 is connected. The core set is previously manufactured from one or more cores which are lined up in a row, so that their openings align. After a temporary fixing, for example by means of adhesive tape, the control winding can be applied. The fixing can remain on the cores after assembly. A plurality of assembly sets can be used according to the number of the cores used, so that the magnetic cross section can be simply adapted by means of the number of cores to the respective device to be manufactured. Instead of the flat section, a band braided from copper strands can also be used, such as is known, for example, for the electrical connection of door and housing as a grounding band.

Figure 3:
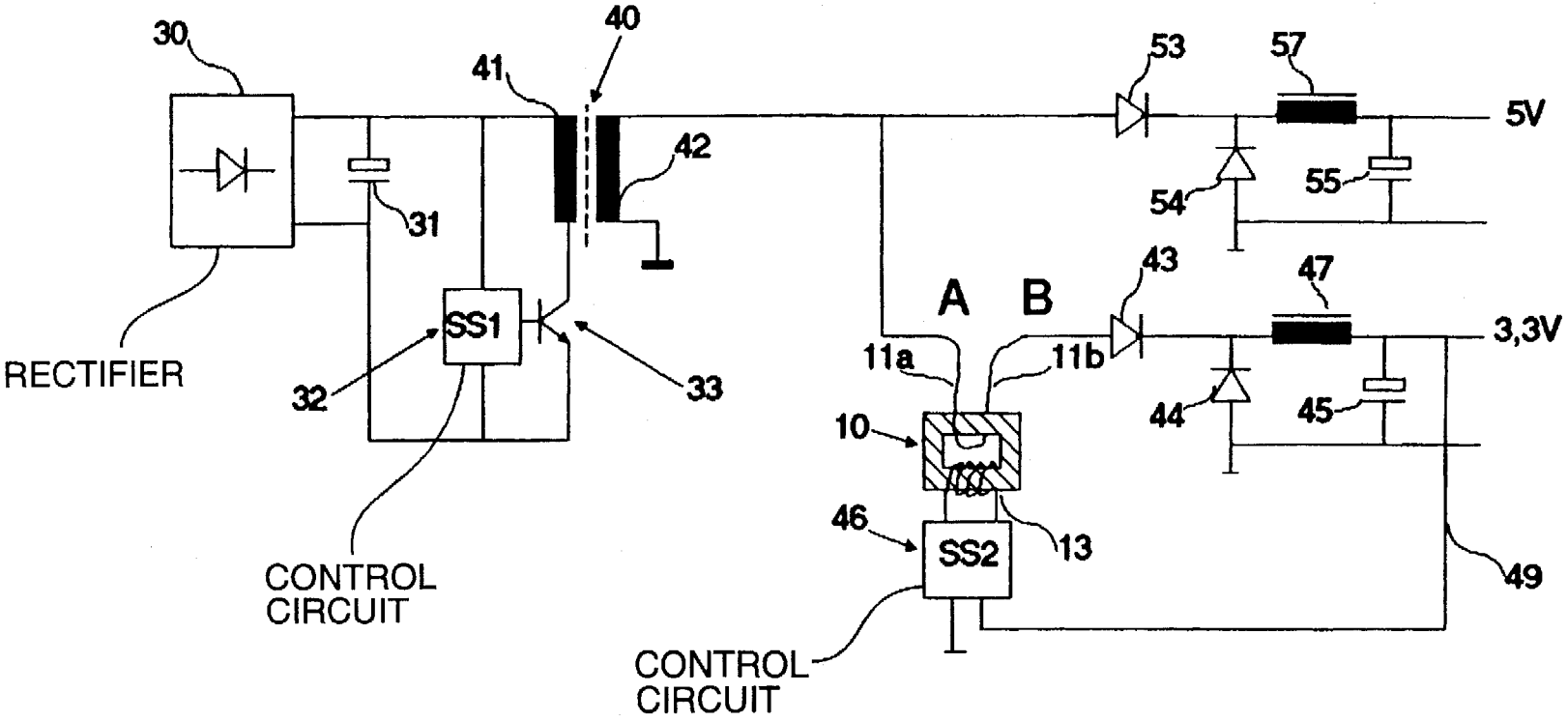

The planar transductor is preferably applied as a transductor for the regulation on the secondary side of the output voltage in primary-clocked switched mode power supplies according to FIG. 3. These comprise a rectifier 30, a filter capacitor 31, a control circuit 32, an electronic switch 33 and a transformer 40 having primary winding 41 and secondary winding 42. The primary winding 41 in this arrangement is fed by the first control circuit 32 with a pulsed current which is rectified on the secondary side. This form of switched mode power supplies, preferably implemented as a forward converter, is generally known, for which reason details of the implementation, in particular also the means of protection, are dispensed with in favor of clarity.

For power supply units in high-power computers, for example, currents of about 300 A at 5.0 V and 3.3 V output voltage are required and must be maintained to 1% precisely even under different load. In FIG. 3, a particularly advantageous arrangement for this case is shown. Here, on the side of the switched mode power supply, only one secondary winding is used, from which 5 V and 3.3 V are obtained at the same time. In this case, the secondary winding 42 comprises only one turn. A second secondary winding would make the figure of merit worse as a result of the then considerably less favorable transformer 40. In this case it is not shown that the output voltage of 5 V is set by means of the control circuit 32. The second output voltage of 3.3 V is then regulated on the secondary side by the planar transductor. The rectifier circuit for both output voltages are implemented in a conventional manner using rectifier diodes 43, 53, filter chokes 47, 57, diodes 44, 54 for accepting the filter choke current and filter capacitors 45, 55.

For the smaller voltage of 3.3 V, the planar transductor is located in series with the secondary winding 42 and the rectifier diode 43. The planar transductor is used in the self-saturating mode of operation. Here, the magnetic field builds up as far as saturation as a result of the current flowing through it. After magnetic saturation of the core 10, the inductance falls to a small value which is designated stray or residual inductance. This value must be very small, since at a high load for the 3.3 V output and at a low load on the 5 V output, only a small voltage difference of less than 1 V is permissible between the points A and B. If the voltage at the 3.3 V output is too large, a current is fed via the control circuit 46 into the winding 13 and, in the current flow pauses, reduces the magnetic flux in the core 10, so that during the next current flow phase the magnetic field in the transductor is first built up as far as saturation and energy is only subsequently fed into the output. The control circuit uses the output voltage to be regulated as reference variable.

In the case of hard magnetic material, as described, a control via a control current is necessary for demagnetization. In the case of soft magnetic cores, the demagnetization can be achieved by idling of the control winding. Both known forms of control can be applied with the invention.

By virtue of the one-piece form of the cores made of ferrites and the simple lining up, the necessary magnetic flux values can thus be achieved in the case of a U-shaped winding made of a copper section, with a simultaneously low stray inductance.

The application of the transductor according to the invention, in spite of the low voltage difference, permits the use of a common winding in the case of switched mode power supplies. A low stray inductance of the transductor is a precondition for this. The stray inductance is the residual inductance with a saturated core. For the given range of 300 A, this could not be achieved using conventional constructions.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A planar transductor comprising:

a primary winding and a secondary winding for controlling said primary winding, at least one one-piece core having a cuboidal configuration and having a passage with a rectangular cross section, through which the primary and the secondary winding are guided, the primary winding being a metallic section having a rectangular cross section, and the metallic section being substantially as wide as one edge length of the passage.

2. The planar transductor as claimed in claim 1, wherein the primary winding has a U-shaped configuration with first and second legs that are parallel to another and spaced apart by a predetermined spacing, said first leg located in said passage of said one-piece core and adjacent to an inner surface of said one-piece core, and said second leg located outside of said one-piece core and adjacent an outer surface of said one-piece core.

3. The planar transductor as claimed in claim 1, wherein the planar transductor further comprises a core that is formed by lining up a plurality of the one-piece cores such that the passages of the one-piece cores are aligned.

4. A forward switched mode converter, comprising:

a primary side coupled to a secondary side;

a planar transductor in said secondary side for effecting output of at least one output voltage;

said planar transductor having a primary winding and secondary winding for controlling said primary winding, at least one one-piece core having a cuboidal configuration and having a passage with a rectangular cross section through which the primary and secondary winding are guided, the primary winding being a metallic section having a rectangular cross section, and the metallic section being substantially as wide as one edge length of the passage.

5. The forward switched mode power supply as claimed in claim 4, wherein at least two output voltages with a low voltage difference are provided at a single common output of the switched mode converter and wherein at least one of the two output voltages is reduced and regulated by the transductor.

6. The forward switched mode power supply as claimed in claim 5, wherein the voltage difference is nominally less than two volts.

* * * * *